United States Patent [19]

Drucker

[11] Patent Number: 5,052,192

[45] Date of Patent: Oct. 1, 1991

[54] DUAL FLOW EXPANSION DEVICE FOR HEAT PUMP SYSTEM

[75] Inventor: Alan S. Drucker, Dewitt, N.Y.

[73] Assignee: Carrier Corporation, Syracuse, N.Y.

[21] Appl. No.: 522,758

[22] Filed: May 14, 1990

[51] Int. Cl.[5] ..... F25B 13/00

[52] U.S. Cl. ..... 62/324.6; 62/528; 62/222; 137/493.8

[58] Field of Search ..... 62/527, 528, 324.1, 62/324.6, 222; 137/493.8, 513.3

[56] References Cited

U.S. PATENT DOCUMENTS 3,404,542 10/1968 Fineblum ..... 62/324.6

4,341,090 7/1982 Ramakrishnan ..... 62/324.6

*Primary Examiner*—Henry A. Bennett

*Assistant Examiner*—John Sollecito

*Attorney, Agent, or Firm*—Frederick A. Goettel, Jr.

[57] ABSTRACT

A mechanical refrigerant expansion valve meters the flow of refrigerant therethrough in one direction through an orifice that varies in cross-sectional area as a function of the pressure differential across the valve. The same valve controls refrigerant flow in the other direction through a fixed area metering orifice.

6 Claims, 2 Drawing Sheets

DUAL FLOW EXPANSION DEVICE FOR HEAT PUMP SYSTEM

BACKGROUND OF THE INVENTION

1. Field of the Invention

This invention relates in general to refrigerant expansion devices for use in thermodynamically reversible compression refrigeration systems having heating and cooling modes of operation. More specifically, this invention relates to a single expansion device that is capable of operating as the expansion device for both the heating and cooling modes of such a system.

2. Description of the Prior Art

A compression refrigeration system comprises a compressor, a condenser, an expansion device and an evaporator connected in a closed circuit to provide refrigeration. Hot compressed refrigerant vapor from the compressor enters the condenser, where it transfers heat to an external heat exchange medium and condenses. Condensed refrigerant, at a high pressure, flows through the expansion device, where the refrigerant undergoes a pressure drop and at least partially flashes to a vapor. The liquid vapor mixture then flows through the evaporator where it evaporates and absorbs heat from the external surroundings. The low pressure refrigerant vapor then returns to the compressor to complete the circuit. It has long been recognized that the energy rejected from a refrigeration cycle during condensation may be used to provide heating. Such a system where the flow of refrigerant through the heat exchangers is reversed has long been referred to as a heat pump.

Typically, to convert the cooling cycle to a heating cycle the duty of the two heat exchangers is thermodynamically reversed. To achieve this result, the direction of refrigerant flow through the system is reversed by changing the connection between the suction and the discharge side of the compressor and the two heat exchangers. This is accomplished for example, by repositioning a four-way valve which interconnects the heat exchangers with the inlet and outlet to the compressor. The cooling condenser then functions as an evaporator, while the cooling evaporator serves as a heating condenser. To complete the thermodynamic reversal, the refrigerant must be throttled in the opposite direction between the heat exchangers. Reversible refrigerant cycles have typically used a capillary tube or a double expansion valve and by-pass system positioned in the supply line connecting the two heat exchangers to accomplish throttling in either direction.

Capillary tubes impose serious limitations upon the operational range of a heat pump system in which they are used and accordingly are not frequently employed.

In the double expansion valve arrangement, two opposed expansion valves are positioned in the refrigerant supply line extending between the two heat exchangers. A valve operated by-pass is also positioned parallel to each expansion valve. When the refrigeration cycle is reversed, the by-pass valves are actuated to alternatively utilize one expansion device and by-pass the other.

Commonly assigned Duell, et. al. U.S. Pat. No. 3,992,898 entitled "Movable Expansion Valve" and issued on Nov. 23, 1976, discloses an expansion device wherein the refrigerant metering port is formed in a free floating piston which is mounted within a chamber. When refrigerant flows through this device in one direction, the free floating piston moves to one position wherein the refrigerant flow is through the metering port thereby serving as an expansion device. When refrigerant flows through this device in the opposite direction, the free floating piston moves to a second position wherein refrigerant is allowed to flow through a number of flow channels formed in the outer peripheral surface of the piston to thereby allow substantially unrestricted flow through the device. This arrangement allows such a device to be used, in combination with a second expansion device of the same design, in a heat pump system to allow the desired expansion of the refrigerant through the system flowing in both the cooling and heating directions. One device is located adjacent to the indoor coil for the cooling mode of operation while the second device is located near the outdoor coil for the heating mode of operation.

In each of the above-described heat pump systems, the system includes two expansion devices, one being dedicated to the cooling mode of operation and the other to the heating mode of operation. Further, each of the expansion devices is of the fixed orifice type wherein a single fixed orifice is selected for each mode of operation which represents a compromise orifice for the wide range of operating conditions which the system may see in each of the modes of operation. One way of obtaining variable control of the expansion orifice is the use of thermostatic expansion valves. A thermostatic expansion valve controls the flow rate of liquid refrigerant entering the coil serving as an evaporator as a function of the temperature and pressure of the refrigerant gas leaving the evaporator. While being highly efficient in their operation and readily responsive to changes in load upon the system to vary the flow of refrigerant to the evaporator, thermostatic expansion valves are also complicated and expensive. Further, in split system type air conditioning and heat pump systems, where the compressor and condenser are located outside at a remote location from the evaporator, the distance of the sensing bulb from the compressor results in less than optimum conditions in such systems.

It has been recognized that the need exists for a refrigerant expansion device which is inexpensive to manufacture and which is effective in performance over a wide range of operating conditions. One approach to solving this problem has been to design a refrigerant flow metering device which has a flow metering passage which varies in cross-section in response to changes between the high and low side pressures in the refrigeration system. One such device is described in commonly assigned David N. Shaw U.S. Pat. No. 3,659,433 entitled "Refrigeration System Including a Flow Metering Device" issued on May 2, 1972.

A refrigerant expansion device that is capable of responding to certain pressure and flow conditions to provide optimum expansion areas within the device for such pressure and flow conditions is disclosed and claimed in commonly assigned U.S. patent application Ser. No. 473,481, filed on Feb. 1, 1990 entitled "Variable Area Refrigerant Expansion Device".

This application discloses a fluid flow metering device which has a housing with a flow passage extending therethrough in which is mounted a movable piston having a flow metering passage extending therethrough. An elongated member within the housing extends into the metering port of the piston. The elongated member and the metering port cooperate to define a flow metering passage between them. The elongated member is configured such that the cross-sectional area varies in relation to the position of the elongated member to the flow metering port. Means are provided for supporting the elongated member within the housing and for controlling the axial position of the elongated member and the piston with respect to one another as a function of the differential pressure across the flow metering piston.

As discussed above in connection with the '898 patent, it is common practice to use two expansion devices in a heat pump system, one dedicated to the cooling mode of operation and the other dedicated to the heating mode.

It has long been an objective to provide a single expansion valve which is capable of providing the expansion function in both the cooling and heating modes of operation of a heat pump system.

One approach has been a dual flow electronic expansion valve. One such valve is disclosed in Hayashi, et al U.S. Pat. No. 4,548,047 entitled "Expansion Valve" issued on Oct. 22, 1985. This patent describes an expansion valve which has the ability to allow reversible flow of the refrigerant to take place. The system disclosed therein allows control of the flow rate of the refrigerant regardless of the direction of flow of the refrigerant, so that control may be effected both in the cooling and heating modes by using a single valve. In this patent, electric input signals are generated by a complex electronic control system which are in turn applied to an electromagnetic coil which controls a plunger which in turn actuates the valve.

Another electronically controlled expansion valve is shown in Alsenz U.S. Pat. No. 4,686,835 entitled "Pulse Controlled Solenoid Valve With Low Ambient Start-up Means", issued on Aug. 18, 1987. Electronically actuated solenoid flow control valves of the type disclosed in these patents require programmed multiprocessor control systems which are extremely expensive. As a result, such control devices are economically attractive in only the most expensive air conditioning-/heat pump systems.

The need accordingly exists for a simple, inexpensive single expansion device that is capable of efficiently controlling a heat pump system in both the heating and cooling modes of operation.

SUMMARY OF THE INVENTION

An object of the present invention is a mechanical refrigerant expansion device which is capable of metering the flow of refrigerant therethrough in either direction.

It is another object of the present invention to meter the flow of refrigerant in a refrigerant expansion device in one direction therethrough through an orifice which varies in size as a function of the pressure differential between the high and low pressure sides of a refrigeration system, and through a fixed metering orifice in the other direction.

It is a further object of the invention to provide a mechanical refrigerant expansion device which is capable of metering the flow of refrigerant for the cooling mode of operation in one direction therethrough and for the heating mode of operation in the other direction.

It is a related object of the present invention to achieve these and other objects with a simple, safe, low cost, reliable expansion device.

These and other objects of the present invention are achieved by an expansion valve for use in a heat pump system which includes a body having a flow passage therethrough for passing a flow of refrigerant in either direction. Means are provided within the body for metering the flow of refrigerant through the valve in one direction through an orifice that varies in cross-sectional area as a function of the pressure differential across the valve. Means are also provided in the valve body for metering the flow of refrigerant in the other direction therethrough through a fixed area metering orifice.

In one embodiment, the objects of the present invention are achieved by an expansion device for metering the flow of refrigerant therethrough which includes a body having a flow passage extending therethrough which defines a first opening at one end thereof and a second opening at the other end. A piston having a first and a second flow metering port formed therein is movably located within the flow passage. An elongated member extends into the first metering port and cooperates with it to define a flow metering passage therebetween. The elongated member is configured so that it varies the cross-sectional area of the flow metering passage in relation to the position of said member to the first flow metering port. Means are provided for supporting the elongated member within the body in alignment with the first flow metering port. Means are provided within the flow passage for limiting movement of the piston in the direction towards the first opening. Means are also provided for biasing the piston towards the stop and at the same time allowing movement away from the stop as a function of the differential pressure across the piston. Means are also provided for preventing the flow of fluid through the flow metering passage in either direction when the piston is in engagement with the stop. Means are also provided for preventing flow of refrigerant through the second metering port of the piston in the direction from the first opening to the second opening, while allowing refrigerant to be metered through the second flow metering port when it is flowing through the device in the direction from the second opening to the first opening.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of the preferred embodiment when read in connection with the accompanying drawings wherein like numbers have been employed in the different figures to denote the same parts, and wherein:

DESCRIPTION OF THE PREFERRED EMBODIMENT

Figure 1:
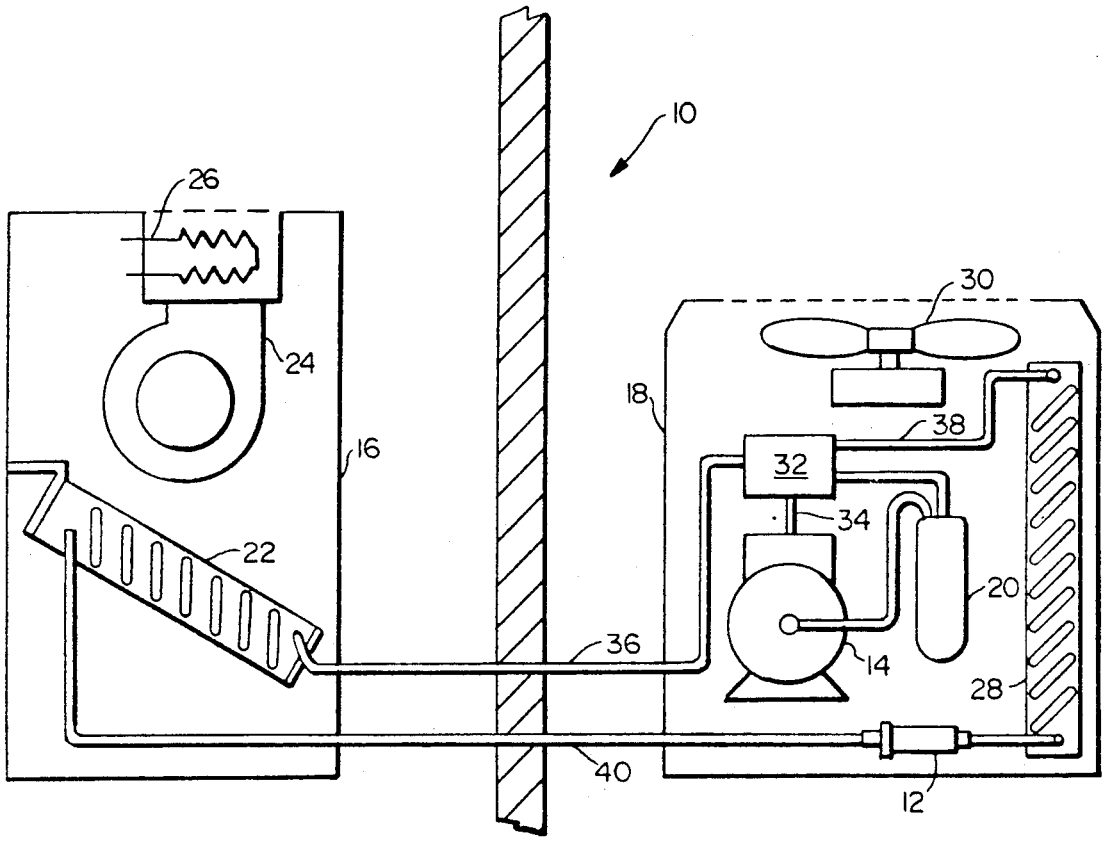
FIG. 1 is a schematic diagram of a heat pump system making use of an expansion device according to the present invention.

With reference first to FIG. 1, numeral 10 designates a heat pump of substantially conventional design, but having a mechanical dual flow expansion valve 12 according to the present invention. The mechanical dual flow expansion valve replaces the multiple expansion devices and check valves and/or the electronically controlled dual flow expansion valves found in the refrigerant line between the heat exchangers of many prior art heat pumps. The operation of the dual flow expansion valve will be described more fully hereinafter. The heat pump 10 also includes a compressor 14, an indoor heat exchanger assembly 16 and an outdoor heat exchanger assembly 18. An accumulator 20 is shown in the compressor suction line 21; however, it is contemplated that, because of the location of the dual flow expansion valve 12, and because of the variable area metering capability of the valve in the cooling mode, the accumulator may not be needed in a system employing the present invention.

The indoor heat exchanger assembly 16 includes a refrigerant-to-air heat exchange coil 22 and an indoor fan 24. The indoor assembly is also shown with a backup electrical resistance heating coil 26. The outdoor heat exchanger assembly 18 includes a refrigerant-to-air heat exchange coil 28 and an outdoor fan 30. The indoor and outdoor heat exchanger assemblies are of conventional design and will not be described further herein.

A four-way reversing valve 32 is connected to the compressor discharge port by a refrigerant line 34, to the compressor suction port by suction line 21 and to coils 22 and 28 by refrigerant lines 36 and 38, respectively. The reversing valve 32 is also of conventional design for directing high pressure refrigerant vapor from the compressor to either the indoor coil 22, in the heating mode of operation or during the cooling mode and defrost, to the outdoor coil 28. Regardless of the mode of operation, the reversing valve serves to return refrigerant from the coil operating as an evaporator to the compressor.

A refrigerant line 40 interconnects the indoor heat exchanger coil 22 and the outdoor heat exchanger coil 28. The dual flow expansion valve 12, according to the present invention, is located in the line 40 within the outdoor heat exchange assembly housing 18, adjacent to the outdoor coil 28. The structure of the dual flow expansion valve 12 will now be described in detail followed by a description of the operation of the valve in the cooling and heating modes of operation and a description of the operational advantages of a system which is equipped with the dual flow expansion valve of the invention.

Turning now to FIGS. 2 through 6, it will be seen that the dual flow expansion valve 12 comprises a generally cylindrical body 42 which defines a cylindrical elongated chamber 44 in the interior thereof. Extending from the right hand end of the body 42 is a threaded nipple 46 having a fluid passageway 48 formed therein which communicates the interior chamber 44 with the exterior thereof. The left hand end of the body 42 is open ended and has a male thread 50 formed on the exterior thereof. The open end of the body 42 is closed by an end cap 52 which has interior threads 54 which mate with the threads 50 on the body. A nipple 56, having a fluid passageway 57 therethrough, extends outwardly from the end cap 52. The fluid passageways 48 and 57 of the nipples 46 and 56, together with the interior chamber 44, define a flow passage through the expansion device.

A circular washer 59 is mounted within the end cap 52 and cooperates with the end of the body 42 to establish a fluid tight seal therebetween.

A three legged spider-like element, hereinafter referred to as the spring retainer 58, is supported within the interior chamber 44 by cooperation between the end cap 52 and an interior groove 60 formed in the interior surface of the open left end of the body 42. Because the retainer has three legs, only one of the legs 62 is shown in the drawing figures as being clamped in the described position by these elements. The spring retainer 58 comprises a central portion 64 through which a threaded opening 66 extends.

Mounted to the spring retainer 58 in a cantilever fashion is a refrigerant metering rod 68. The refrigerant metering rod comprises a reduced diameter threaded portion 70 which is adapted to be received within the threaded opening 66 in the spring retainer 58. Extending from its attachment to the spring retainer 58, the refrigerant metering rod comprises a flow metering geometry bearing portion 72, and terminates in enlarged end portion 74. As shown, the flow metering geometry bearing portion 72 of the rod 68 is a pair of flat tapers, which extend from the left hand end of the rod and converge to the right to define a rod cross-section of decreasing size.

Figure 2:
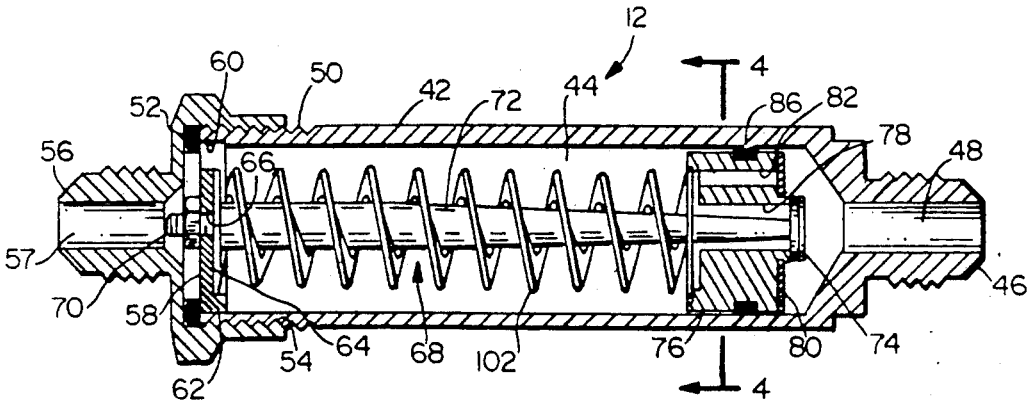
FIG. 2 is a longitudinal sectional view through an expansion device according to the present invention.
Figure 3:
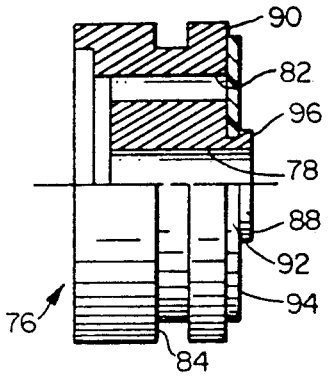
FIG. 3 is an enlarged partial sectional view of the flow metering piston of the expansion device of FIG. 2.
Figure 4:
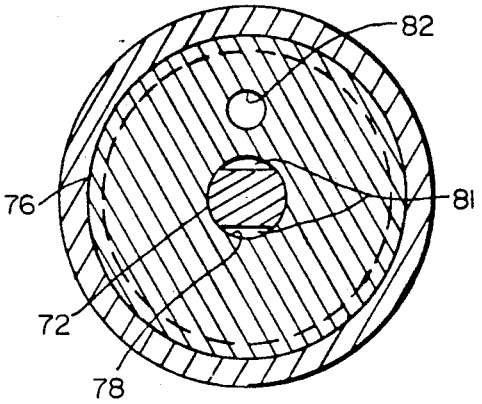
FIG. 4 is a sectional view of the expansion device taken along the lines IV—IV of FIG. 2.

With continued reference to FIGS. 2 through 6 and with particular attention to the details shown in FIGS. 3 and 4, a flow metering piston 76 is generally cylindrical in shape and has a first flow metering port 78 extending axially, centrally therethrough. The first flow metering port 78 is of such a size that the flow metering geometry bearing portion 72 of the metering rod 68 is readily received therein to allow free relative axial movement of the flow metering piston 76 with respect to the rod. The space defined between the first flow metering port 78 and the flow metering geometry portion 72 of the rod 68 is defined as the variable area flow metering passage 80. The interaction between these components to vary the area of the variable area flow metering passage 80 will be described in more detail as the description of the preferred embodiment continues.

A second flow metering port 82 extends axially through the piston 72 at a location radially displaced from, and substantially parallel to, the first flow metering port 78. The second flow metering port 82 defines a fixed cross-sectional area flow metering passage through the piston 76.

The outside diameter of the piston 76 is of such a dimension that the piston is received within the cylindrical chamber 44 of the body 42 with a clearance allowing free axial motion of the piston with respect to the body. An annular groove 84 is machined into the outside of the surface of the piston and a suitably sized O-ring 86 is adapted to be received therein in a manner such that it cooperates with the groove 84 and the inside surface of the chamber 44 to preclude refrigerant flow between the surfaces when the device is in operation in a refrigeration system.

As best shown in FIG. 3, a centrally located, reduced diameter boss 88 extends from the right hand facing end surface 90 of the flow metering piston 76. The boss 88 has an annular groove 92 defining an area of reduced diameter immediately adjacent the right hand facing surface 90. The groove 92 is adapted to receive and retain a washer-shaped, flexible seal element 94 having a central opening therethrough 96 which defines an inner diameter which allows it to be received in and to be retained by the groove 92. The outer diameter of the seal 94 is slightly less than the outside diameter of the piston 76. The seal 94 completely overlies the second flow metering port 82 and serves to prevent refrigerant flow into the second flow metering port when refrigerant is flowing through the expansion valve 12 in a direction from right to left. The seal 94 is further configured such that it will move out of obstructing relationship with the second flow metering port 82 when refrigerant is flowing through the device from left to right in order to allow the second flow metering port 82 to accurately meter the flow of refrigerant therethrough as will be understood as the description continues. In the preferred embodiment, the seal 94 is fabricated from a synthetic resin such as teflon.

Figure 5:
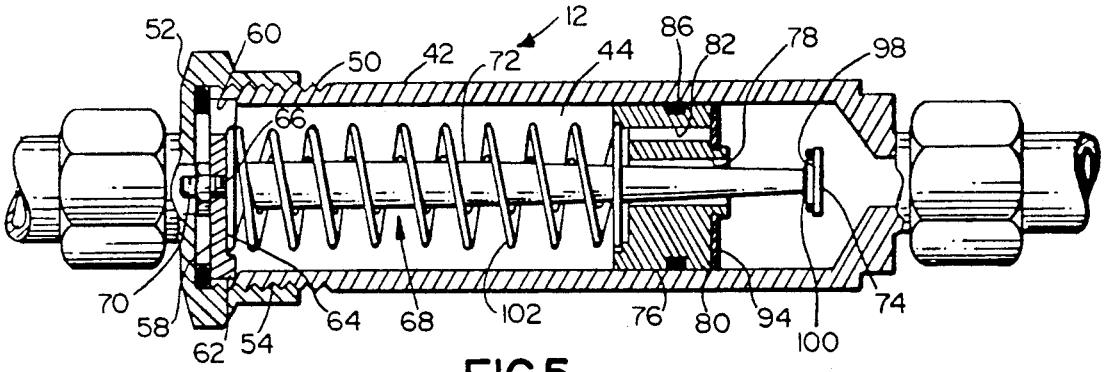
FIG. 5 is a longitudinal sectional view of the expansion device of FIG. 1 with refrigerant lines operably connected thereto and showing operation of the device while in the cooling mode of operation.
Figure 6:
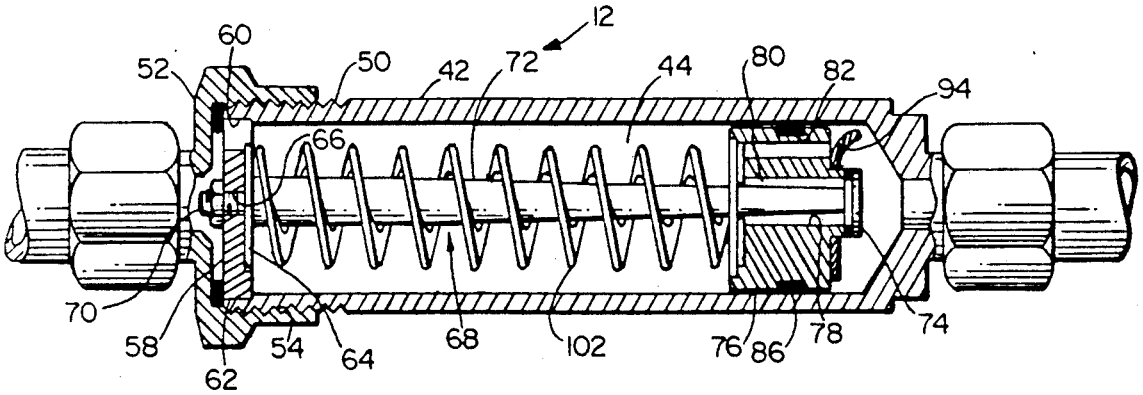
FIG. 6 is a longitudinal sectional view of the expansion device of FIG. 1 with refrigerant lines operably connected thereto and showing operation of the device during the heating mode of operation.

As best seen in FIGS. 2, 5 and 6, the previously referred to enlarged end portion 74 of the flow metering rod 68 defines an enlarged annular planar surface 98 facing to the left as viewed in the drawing figures. This surface 98 and the smaller diameter portion of the rod adjacent thereto serve to receive and support a metering rod seal 100. The seal 100 is made from a material which will swell or otherwise seal when exposed to a refrigerant to assure retention of the seal in the described position. A neoprene O-ring has performed satisfactorily in practice. The enlarged end 74 and the O-ring seal 100 carried thereby serve as stop means for limiting the motion of the piston 76 to the right. Furthermore, the O-ring seal 100 is adapted to engage the right hand facing annular surface 102 of the boss 88 on the piston to thereby establish a fluid-tight seal when the piston is urged into contact with the O-ring as will be hereinafter appreciated.

A refrigerant metering spring 102, comprising a helically wound spring is disposed within the expansion valve body 42 in coaxial relationship with the metering rod 68. The ends of the spring 102 engage the spring retainer 58 and the left hand facing end surface of the refrigerant metering piston 76. In the preferred embodiment, the spring is partially compressed between the spring retainer 58 and the piston to preload the refrigerant metering assembly. This preloading is accomplished during assembly of the device by simply threading the spring retainer 58 onto the threaded end 70 of the metering rod 68 thereby compressing the spring to the desired level of preload. Following this, a lock nut 104 is threaded onto the end 70 of the rod to securely lock the retainer in the desired preload position. A lock washer (not shown) may be used to assure a positive connection.

As previously discussed in connection with FIG. 1, an assembled dual flow expansion valve 12 is installed in the refrigerant line 40 extending between the indoor coil 22 and the outdoor coil 28 of a heat pump. As shown, the expansion device 12 is positioned in the outdoor heat exchanger assembly 18 close to the outdoor coil 28. The orientation of the device as installed is as shown in the drawing figures and, as will be understood, the variable area flow metering passage 80 serves as the cooling expansion orifice (with flow from left to right) and the fixed flow metering passage 82 serves as the heating orifice (with flow from right to left) during operation of the system.

Referring now to FIG. 2, the dual flow expansion valve 12 is shown in a static-no flow condition. For the description that follows it is stipulated that the reversing valve 32 is positioned so that the system will operate in the cooling mode wherein the outdoor coil 28 functions as a condensing coil and the indoor coil 22 functions as an evaporator.

As shown, the spring 102 has been pre-loaded (as described above) and, urges the piston 76 into fluid tight engagement with the O-ring 100 carried by the rod 68 (as also described above). As a result, no refrigerant may flow through the flow metering passage 80 until the force on the piston, due to operation of the refrigeration system, exceeds the force on the piston caused by the preload of the spring. As a result of the above-described positive shut-off feature, the expansion device 12 is capable of preventing refrigerant migration from the high pressure side to the low pressure side when the system in which it is installed is shut off. It also follows that the system is able to maintain a pressure differential between the high and low side when the system is off. A direct benefit of this is that the degradation coefficient $C_D$ of the refrigerant system is reduced. The degradation coefficient is a term defined by the U.S. Department of Energy which relates to the measure of the efficiency loss of the system due to the cycling of the system.

The pre-load of the spring also sets what may be referred to as the system threshold pressure differential. Once set by suitably pre-loading the spring, this pressure differential must be reached in the system before the expansion device will begin to allow the flow of refrigerant therethrough.

At the start of a cooling mode cycle, the pressure differential across the dual flow expansion valve 12 will begin to develop, with the high side being to the right of the piston 76 and the low side to the left thereof. As the pressure differential across the piston develops, it urges the piston to move to the left against the force of the spring 102. When the pressure differential exceeds the force exerted by the preloaded spring, i.e., the threshold pressure differential for the system is exceeded, refrigerant begins to flow through the variable area flow metering passage 80 between the flow metering rod and the first flow metering port 78. FIGS. 4 and 5 illustrate the expansion device 12 as it appears in operation with an intermediate pressure drop, e.g., about 150 psi, across the piston. With specific reference to FIG. 4, it will be noted that the variable area flow metering passage 80 is made up of two discrete segments, each bearing the reference number 81, on opposite sides of the rod. These segments 81 are defined by the tapers formed on the flow metering geometry bearing portion of the rod 72 as previously described hereinabove.

As a general rule, in controlling the flow of refrigerant in a cooling mode of operation, it has been found that the cross-sectional area of the metering portion of the rod 72 should progress from a smaller value adjacent the enlarged end 74 to a larger cross-sectional area as the left hand end of the rod is approached. The relationship thus established is that the flow metering passage 80 defined by the first flow metering port 78 and the rod portion 72 is larger at low pressure differentials and decreases as the pressure differential across the piston 76 increases. It should accordingly be appreciated that the operation of the dual flow expansion valve 12 described above allows the device to control the cross-sectional area of the variable area flow metering passage 80 as a function of the pressure differential across the movable piston 76. By performing a pressure balance analysis on the piston, a designer is able to customize the geometry of the expansion device such that it is able to control the flow of refrigerant in a refrigeration system at optimum conditions over a wide range of operating conditions. The object of the design is to provide an optimum expansion area (i.e. the area of 80) for a variety of different indoor and outdoor temperature and humidity conditions. This is achieved by changing the cross-sectional area of the flow metering bearing portion 72 of the rod 68 by machining a flow metering geometry thereon.

To operate the heat pump system 10 in the heating mode of operation, the setting of the reversing valve 32 is changed. As a result, hot gaseous refrigerant is discharged from the compressor 14 to the reversing valve 32 which directs the hot gaseous refrigerant to the indoor coil 22 which is now operating as a condenser and rejecting heat to the indoor space being heated. From the indoor condenser 22 the refrigerant is directed via refrigerant line 40 to the outdoor heat exchange assembly 18 where it passes through the dual flow expansion device 12 and thence to the outdoor coil 28 which now serves as an evaporator.

FIG. 6 depicts the dual flow expansion valve 12 in the heating mode of operation. During such operation, the piston 76 is urged into sealing engagement with the O-ring 100 carried by the enlarged end 74 of the refrigerant metering rod 68. As a result, no refrigerant is allowed to pass through the variable area flow metering passage 80. The high pressure side of the system as thus operated is to the left of the piston 76 and, as a result, a flow of refrigerant is metered through the second flow metering port 82 of the piston. As is shown in the figure, the seal 94 moves out of flow obstructing relationship with the second flow metering port 82 and, because the port 82 has been selectively sized to match the requirements of the heat pump system in the heating mode of operation, the port 82 serves to control the flow of refrigerant through the device 12 at the optimum flow rate that may be achieved by a fixed orifice metering device.

A substantial reduction in the amount of refrigerant charge required in a split system heat pump system may be realized by the use of the dual flow expansion valve of the present invention. Further significant cost advantages, due to the reduction in refrigerant charge required, may be realized by the elimination of an accumulator.

A typical split system residential heat pump system is designed with a substantially greater outdoor coil volume than indoor coil volume. This is done to maximize the cooling performance of the system, which is typically the major selling feature or purpose of a heat pump system. Because of the substantially larger outdoor coil volume, the circulated refrigerant charge is proportionately greater for cooling cycle operation than heating cycle operation. As a result of the necessity of using the higher charge quantities, heating operating modes are subject to flooding of the compressor which reduces the capacity and reliability of the system. Accumulators are necessarily used in such systems to prevent the flow of liquid refrigerant through the suction line to the compressor.

The variable area expansion capability of the dual flow expansion valve 12 of the present invention, in the cooling mode of operation, allows the device to adapt the expansion area to system operating conditions thereby optimizing values of subcooling and superheat. Tests using the variable area expansion valve have shown that a 30% reduction in refrigerant charge may be realized compared to an identical refrigeration system using a pair of fixed orifice expansion devices, i.e. one dedicated to cooling and the other to heating.

A further decrease in refrigerant charge is realized with application of the dual flow expansion valve 12 by positioning the device at the outdoor coil instead of the indoor coil where the cooling expansion device is usually located. Such positioning means that the refrigerant line 40, during the cooling mode of operation, contains a two-phase flow, instead of 100% liquid which it would contain were a conventional cooling expansion device positioned in the liquid line immediately preceding the indoor (evaporator) coil. Less refrigerant is thus necessary to fill the line.

Accordingly, it should be appreciated that a refrigerant expansion valve has been provided that meters the flow of refrigerant therethrough in one direction through an orifice that varies in cross-sectional area as a function of the pressure differential across the valve. The same expansion valve controls refrigerant flow in the other direction through a fixed area metering orifice.

This invention may be practiced or embodied in still other ways without departing from the spirit or essential character thereof. The preferred embodiment described herein is therefore illustrative and not restrictive, the scope of the invention being indicated by the appended claims and all variations which come within the meaning of the claims are intended to be embraced therein.

What is claimed is:

1. An expansion device for metering the flow of refrigerant therethrough comprising:

a body having a flow passage therethrough for passing a flow of refrigerant, said flow passage including a first opening at one end thereof and a second opening at the other end thereof;

a piston having a first and a second flow metering port extending axially therethrough, said second flow metering port defining a fixed area flow metering passage, said piston being movably disposed within said flow passage;

an elongated member extending into said first flow metering port, said member and said first flow metering port cooperating to define a variable area flow metering passage therebetween, said member being configured to vary the cross-sectional area of said flow metering passage in relation to the position of said member to said first flow metering port;

means for supporting said member within said body in axial alignment with said first flow metering port;

stop means for limiting movement of said piston in the direction towards said first opening;

means for biasing said piston towards said stop and for allowing movement of said piston away from said stop as a function of the differential pressure across said piston;

means for preventing fluid flow through said variable area flow metering passage, in either direction, when said piston is in engagement with said stop;

means for preventing flow of refrigerant through said fixed area flow metering passage, in the direction from said first opening to said second opening, while allowing refrigerant to be metered through said fixed area flow metering passage, when it is flowing through said device in the direction from said second opening to said first opening.

2. The apparatus of claim 1 wherein the cross-sectional area of said elongated member increases for at least a portion of its length in going in the direction from said first opening to said second opening.

3. The apparatus of claim 2 wherein said elongated member extends through said first flow metering port, wherein said means for supporting said elongated member comprises, means for rigidly attaching the end of said elongated member adjacent to said second opening to said body; and, wherein said stop means comprises an enlarged portion at the other end of said elongated member.

4. The apparatus of claim 3 wherein said means for preventing fluid flow through said variable area flow metering passage comprises:

a seal member carried by said elongated member adjacent to said enlarged portion, said seal member being configured to plug said first flow metering port when said piston is biased into engagement with said stop means.

5. A refrigerant expansion valve for use in a heat pump comprising:

a body having a flow passage for passing a flow of refrigerant in either direction;

means within said body for metering the flow of refrigerant therethrough in one direction through an orifice that varies in cross-sectional area as a function of the pressure differential across said valve; and means within said body for metering the flow of refrigerant in the other direction therethrough through a fixed area metering orifice.

6. In a heat pump system having a compressor, a first heat exchanger and a second heat exchanger being selectively connected to the compressor, switching mean for selectively connecting the inlet and discharge side of the compressor between the heat exchangers, and, a refrigerant supply line for delivering refrigerant from one heat exchanger to the other, the improvement comprising;

a refrigerant expansion valve mounted in the supply line, said valve including: a body; means within said body for metering the flow of refrigerant therethrough in one direction through an orifice that varies in cross-sectional area as a function of the pressure differential across said valve; and, means within said body for metering the flow of refrigerant in the other direction therethrough through a fixed area metering orifice.

* * * * *